US006119092A

United States Patent [19]

Patwardhan et al.

[11] Patent Number: 6,119,092

[45] Date of Patent: Sep. 12, 2000

[54] AUDIO DECODER BYPASS MODULE FOR COMMUNICATING COMPRESSED AUDIO TO EXTERNAL COMPONENTS

[75] Inventors: Arvind Patwardhan; Kosala Abeywickrema, both of San Jose; Sophia Kao, Cupertino, all of Calif.

[73] Assignee: LSI Logic Corporation, Milpitas, Calif.

[21] Appl. No.: 09/105,614

[22] Filed: Jun. 26, 1998

[51] Int. Cl.[7] ..... G10L 19/00; G10L 21/04

[52] U.S. Cl. ..... 704/503; 704/500; 704/504; 704/229; 704/230

[58] Field of Search ..... 704/500, 501, 704/502, 503, 504, 229, 230; 369/48; 381/94.4

[56] References Cited

U.S. PATENT DOCUMENTS

| | | | |
|---|---|---|---|
| 5,608,697 | 3/1997 | De Haan et al. | 369/48 |
| 5,815,634 | 9/1998 | Daum et al. | 386/96 |
| 5,825,899 | 10/1998 | Yamaguchi et al. | 381/94.4 |
| 5,884,269 | 3/1999 | Cellier et al. | 704/501 |
| 5,890,109 | 3/1999 | Walker et al. | 704/215 |
| 5,893,066 | 4/1999 | Hong | 704/500 |

OTHER PUBLICATIONS

*DVD Audio Decoder Having Efficient Deadlock Handling*, Wen Huang, U.S. Patent Application Ser. No. 09/105,490, filed Jun. 26, 1998.

*DVD Audio Decoder Having A Direct Access PCM FIFO*, Wen Huang, Arvind Patwardhan and Darren D. Neuman, U.S. Patent Application Ser. No. 09/105,487, filed Jun. 26, 1998.

*DVD Audio Decoder Having A Central Sync–Controller Architecture* Wen Huang and Sophia Kao, U.S. Patent Application Ser. No. 09/105,969, filed Jun. 26, 1998.

*Primary Examiner*—David R. Hudspeth
*Assistant Examiner*—Vijay B Chawan
*Attorney, Agent, or Firm*—Conley, Rose & Tayon, PC; B. Noel Kivlin

[57] ABSTRACT

A multimedia decoder is provided with an audio decoder bypass module for forwarding undecoded audio bitstreams directly to external system components. In one embodiment, the multimedia decoder includes an audio decoder, and a bypass module. The audio decoder operates on the data in an audio bitstream buffer to convert at least a portion of the audio bitstream into a set of digital audio signals. The bypass module is configured to provide the full information content of the audio bitstream to an external system component which may be able to convert a greater portion of the audio bitstream into a second set of digital audio signals. As the audio decoder and bypass module each retrieve data from the audio bitstream buffer, they each use a pointer to track which location of the buffer to access next. The bypass module maintains a loose synchronization with the audio decoder by calculating the difference between the pointers and transmitting the current audio packet only if the magnitude of the difference doesn't exceed a predetermined threshold. If the bypass module is lagging behind the audio decoder by more than the threshold amount, then it skips ahead to the next audio packet. On the other hand, if the decoder is lagging behind the bypass module by more than the threshold amount, the bypass module waits for the audio decoder to catch up. This technique advantageously prevents detectable discrepancies in reproduced audio signals while allowing for system upgradability without significant increase in implementation cost.

19 Claims, 4 Drawing Sheets

AUDIO DECODER BYPASS MODULE FOR COMMUNICATING COMPRESSED AUDIO TO EXTERNAL COMPONENTS

BACKGROUND OF THE INVENTION

1. Field of the Invention

This invention relates to the field of multimedia decoders, and in particular to a multimedia decoder with an audio bypass module that can provide compressed audio in parallel with decompressed audio to external system components.

2. Description of the Related Art

Digital audio and video programs in initial sampled form and final playback form comprise an enormous amount of data, indeed so much that it would be prohibitively expensive to store or to secure the necessary bandwidth and power to transmit programs of moderate quality and length. To address this problem, compression techniques are commonly employed to reduce the amount of data by which the program is represented during storage and transmission, after which the program is reconstructed by some matched decompression method. To ensure compliance between transmitters and receivers of various manufacturers, several compression standards have been established. For audio compression, MUSICAM and Dolby AC-3 are popular. For multimedia (audio/video) compression, MPEG and DVD are popular.

These standards are not completely distinct and independent, e.g. DVD employs MPEG video compression techniques and allows for use of MUSICAM and AC-3 audio compression techniques. Although attention herein is directed primarily to the DVD standard, much of what is said is also applicable to systems operating according to other compression standards, and exclusion of such systems is not intended.

A compressed bitstream created in accordance with the DVD standard consists of interleaved substreams. Examples of substreams which may be included in a DVD bitstream include audio substreams, a video substream, sub-picture unit (SPU) substreams, and navigation substreams. Each substream consists of data packets having a packet header and a packet payload. The packet header includes identifying information specifying which substream the packet belongs to and where it belongs in that substream. The packet header also includes information specifying the payload type and size, and any compression parameters which may be required for decompression.

To reconstruct the original data from the DVD bitstream, a DVD decoder locates the beginning of a packet, then reads the packet header to determine the substream membership. The decoder then routes the packet payload and portions of the packet header to the appropriate elementary bitstream buffer. Various modules of the decoder then operate on the contents of each buffer to reconstruct the associated program component (i.e. audio, video, SPU, navigation), and the reconstructed program component is finally presented to an appropriate output channel for delivery to the user.

As used herein, "substream" refers to the stream of data packets associated with a program component, and elementary bitstream refers to the data which is written to the elementary bitstream buffers, i.e. the contents of the data packet minus the identifying header fields, but including header fields which specify decompression parameters that may be needed by the ensuing decoder modules. For example, an AC-3 audio data packet written to an elementary bitstream buffer could include the header fields carrying AC-3 compression parameters, but may be stripped of DVD header fields such as the field identifying the data packet as an audio substream packet.

Many economical audio decoders are configured to decode only two audio channels and to discard any additional channels which may be encoded, e.g. center, surround, low-frequency effects (LFE) channels. Later system upgrades could include external components capable of decoding these additional channels. It is desirable to provide a method for allowing external components to operate in conjunction with or in place of these economical audio decoders.

SUMMARY OF THE INVENTION

Accordingly, there is provided herein a multimedia decoder that includes an audio decoder bypass module for forwarding undecoded audio bitstreams directly to external system components while using input buffer pointers to maintain synchronization between the bypass module and the audio decoder. In one embodiment, the multimedia decoder includes a pre-parser, a memory, a video decoder, an audio decoder, and a bypass module. The pre-parser receives the multimedia bitstream and extracts the component substreams. The video substream is forwarded to a video bitstream buffer in the memory, and the audio substream is forwarded to an audio bitstream buffer in the memory. The video decoder operates on the data in the video bitstream buffer to produce a sequence of video frames. The audio decoder operates on the data in the audio bitstream buffer to convert at least a portion of the audio bitstream into a set of digital audio signals. The bypass module is configured to provide the full information content of the audio bitstream to an external system component which may be able to convert a greater portion of the audio bitstream into a second set of digital audio signals. As the audio decoder and bypass module each retrieve data from the audio bitstream buffer, they each use a pointer to track which location of the buffer to access next. The bypass module maintains a loose synchronization with the audio decoder by calculating the difference between the pointers and transmitting the current audio packet only if the magnitude of the difference doesn't exceed a predetermined threshold. If the bypass module is lagging behind the audio decoder by more than the threshold amount, then it skips ahead to the next audio packet. The difference between the pointers may be again compared with the predetermined threshold, and the skip repeated if the bypass module still lags too far behind. On the other hand, if the decoder is lagging behind the bypass module by more than the threshold amount, the bypass module waits for the audio decoder to catch up. The bypass module may enter a wait state and remain there until the difference is less than a second predetermined value. This technique advantageously prevents detectable discrepancies in reproduced audio signals while allowing for system upgradability without significant increase in implementation cost.

BRIEF DESCRIPTION OF THE DRAWINGS

Other objects and advantages of the invention will become apparent upon reading the following detailed description and upon reference to the accompanying drawings in which.

Figure 1:
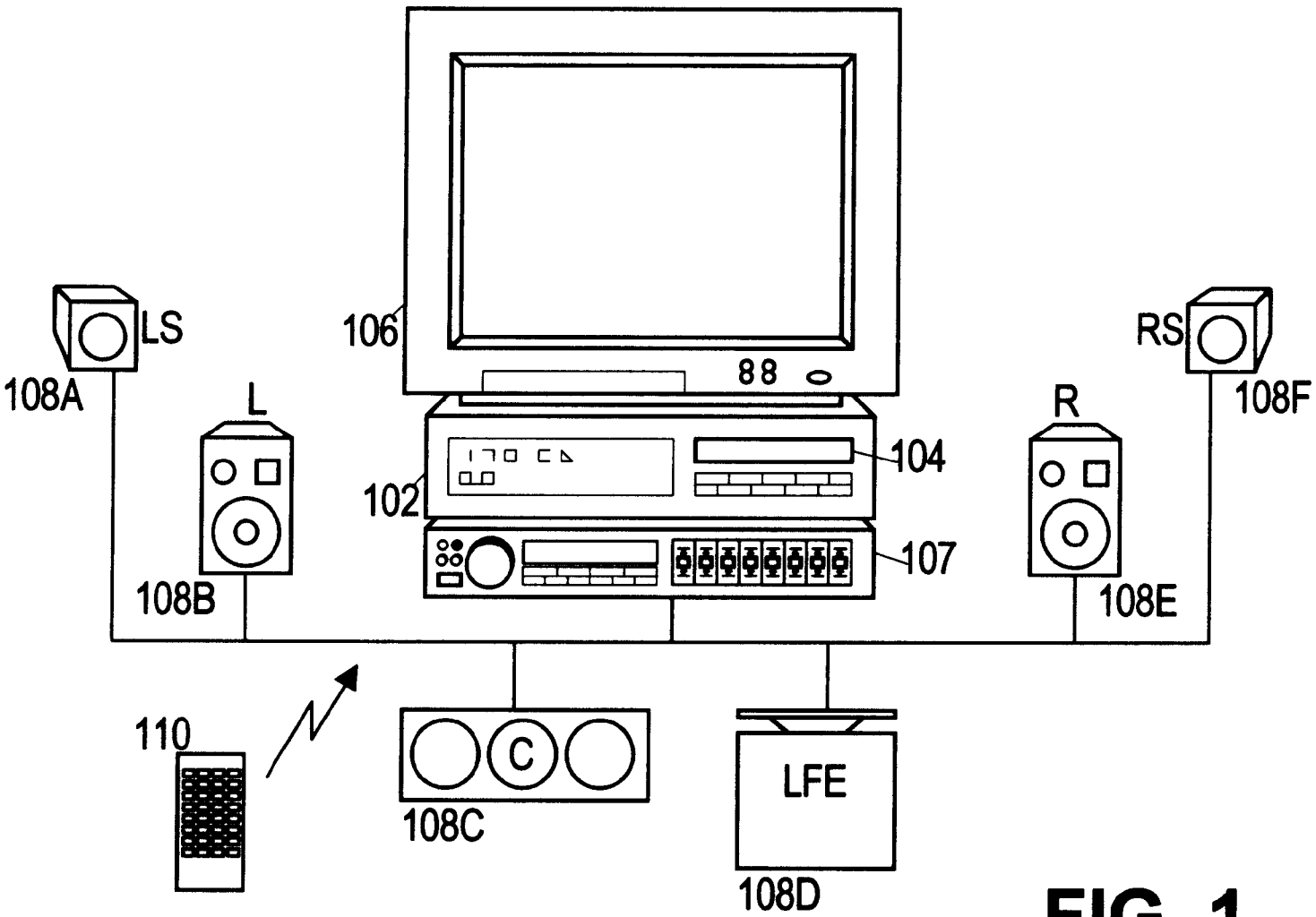
FIG. 1 shows a multimedia system which includes a multi-channel audio subsystem.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Turning now to the figures, FIG. 1 shows a video playback device 102 which includes a multimedia disc drive 104. The video playback device 102 is coupled to a display monitor 106 and a digital audio system controller 107, and can be controlled via a remote control 110. The digital audio system controller 107 is coupled to a speaker system 108. The device 102 accepts multimedia discs in drive 104, and can read compressed multimedia bitstreams from the multimedia disc. The device 102 can convert the multimedia bitstreams into audio and video signals and present the video signal on display monitor 106 and the audio signals on stereo speakers 108B, 108E. For economic reasons, video playback device 102 includes a multimedia decoder with an economical audio decoder which only decodes left and right audio channels from compressed audio bitstreams. Advantageously, device 102 provides for upgradability since the multimedia decoder includes an audio bypass module that advantageously provides the full content of a compressed audio bitstream to external components such as the digital audio system controller 107 for reproduction over the full speaker set 108.

The digital audio system controller 107 may provide for decoding of compressed audio bitstreams and further provide for digital equalization and mixing of digital audio channels to provide phenomenal control over any multichannel speaker system. Digital audio system controller 107 could be provided as an upgrade component to existing two-channel systems to enable full surround-sound theater-quality audio reproduction of compressed multimedia programs. Digital audio system controller 107 may include a digital interface for receiving digital audio bitstreams from other system components. An example of one such interface is the IEC958 interface and extensions thereof which are described in the DVD specification ("IEC958 To Convey Non-PCM Encoded Audio Bitstreams", August 1996, pages ABS-0 through ABS-30).

The speaker set 108 may exist in various configurations. A single center speaker 108C may be provided. Alternatively, a pair of left and right speakers 108B, 108E may be provided and used alone or in conjunction with a center speaker 108C. Four speakers, 108B, 108C, 108E, 108F may be provided in a left, center, right, surround configuration, or five speakers 108A, 108B, 108C, 108E, 108F may be provided in a left surround, left, center, right, right surround configuration. Additionally, a low-frequency speaker 108D may be provided in conjunction with any of the above configurations. All these configurations may be flexibly supported by digital audio system controller 107.

In one embodiment, multimedia drive 104 is configured to accept a variety of optically readable disks. For example, audio compact disks, CD-ROMs, DVD disks, and DVD-RAM disks may be accepted. The drive 104 can consequently read audio programs and multimedia bitstreams. The drive 104 may also be configured to write multimedia bitstreams, and may additionally be configured to write audio programs. The drive 104 includes a multimedia decoder which converts read multimedia bitstreams into video displays and audio programs. The drive 104 may also include a multimedia encoder for converting video displays and audio programs into a multimedia bitstream. A user can instruct the device 102 to forward any received video displays and audio programs directly to the display monitor 106 and digital audio system controller 107 for display and audio playback.

Figure 2:
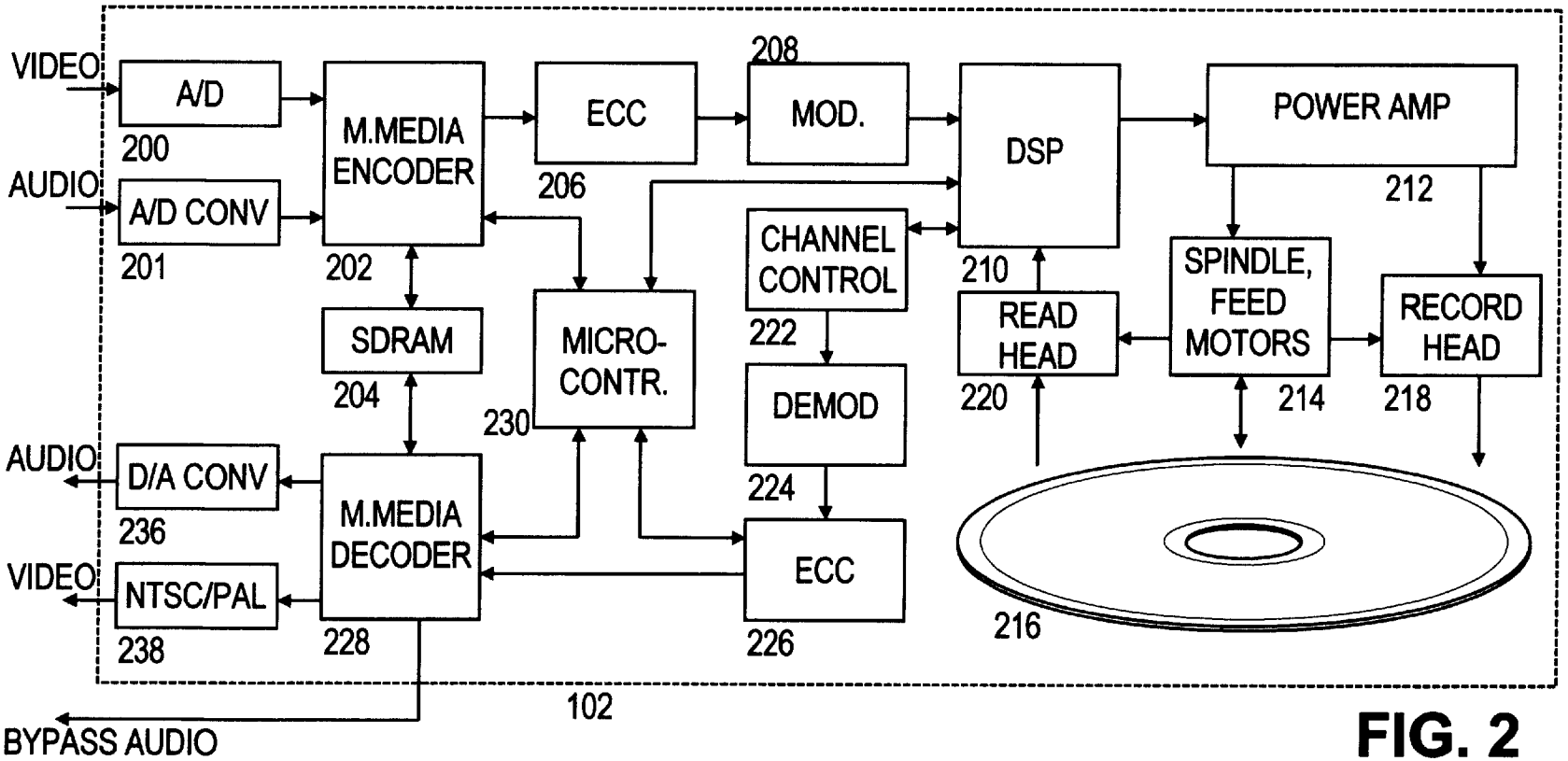
FIG. 2 shows a functional block diagram of a multimedia recording and playback device.

Turning now to FIG. 2, a functional block diagram of one embodiment of a video recording and playback device 102 is shown. The device 102 provides audio and video signals to the display monitor 106, and can provide a digital audio bitstream to an external component. The device 102 can also accept audio and video signals from a television tuner or some other source. The received video and audio signals are converted to digital video and audio signals by A/D converters 200, 201. The digital audio and video bitstreams are provided to multimedia encoder 202. Multimedia encoder 202 uses synchronous dynamic random access memory (SDRAM) 204 as a frame store buffer while encoding the received signals. The resulting multimedia bitstream is processed by an error correction encoder 206 and then converted to a modulated digital signal by modulator 208. The modulated digital signal is coupled to a digital signal processor (DSP) 210 and from there to a power amplifier 212. Amplified signals are coupled to drive motors 214 to spin a recordable multimedia disk 216, and to a record head 218 to store the modulated digital signal on the recordable multimedia disk 216.

Stored data can be read from the recordable multimedia disk 216 by read head 220 which sends a read signal to DSP 210 for filtering. The filtered signal is coupled to channel control buffer 222 for rate control, then demodulated by demodulator 224. An error correction code decoder 226 converts the demodulated signal into a multimedia bitstream which is then decoded by multimedia decoder 228. In decoding the multimedia bitstream, the multimedia decoder 228 produces digital audio and video bitstreams which are provided to D/A converters 236 and 238, which in turn provide the audio and video signals to display monitor 106. Video D/A 238 is typically an NTSC/PAL rasterizer for television, but may also be a RAMDAC for other types of video screens. Some of the various components are now described in greater detail.

Multimedia encoder 202 operates to provide compression of the digital audio and video signals. The digital signals are compressed individually to form bitstreams which are then divided into packets which are inter-mixed to form the compressed multimedia bitstream. Various compression schemes may be used, including MPEG and DVD.

In one embodiment, the general nature of the video compression performed by multimedia encoder 202 is MPEG encoding. The video compression may include subsampling of the luminance and chrominance signals, conversion to a different resolution, determination of frame compression types, compression of the frames, and re-ordering of the frame sequence. The frame compression may be intraframe compression or interframe compression. The intraframe compression is performed using a block discrete cosine transform with zigzag reordering of transform coefficients followed by run length and Huffman encoding of the transform coefficients. The interframe compression is performed by additionally using motion estimation, predictive coding, and coefficient quantization.

In one embodiment, the general nature of the audio compression performed by multimedia encoder 202 is MPEG-2/AC-3 encoding. The audio compression may include locking the input sampling rate to the output bit rate, sample rate conversion, input filtering, transient detection, windowing, time-to-frequency domain transformation, channel coupling, rematrixing, exponent extraction, dithering, encoding of exponents, mantissa normalization, bit allocation, quantization of mantissas, and packing of audio frames, e.g. for AC-3 encoding. Similarly, the audio compression may include filter bank synthesis, calculation of signal to noise ratio, bit or noise allocation for audio samples, scale factor calculation, sample quantization, and formatting of the output bitstream, e.g. for MPEG-2 encoding. For either method, the audio compression may further include subsampling of low frequency signals, adaptation of frequency selectivity, and error correction coding.

Error correction encoder 206 and modulator 208 operate to provide channel coding and modulation for the output of the multimedia encoder 202. Error correction encoder 206 may be a Reed-Solomon block code encoder, which provides protection against errors in the read signal. The modulator 208 converts the error correction coded output into a modulated signal suitable for recording on multimedia disk 216.

DSP 210 serves multiple functions. It provides filtering operations for write and read signals, and it acts as a controller for the read/write components of the system. The modulated signal provided by modulator 208 provides an "ideal" which the read signal should approximate. In order to most closely approximate this ideal, certain nonlinear characteristics of the recording process must often be compensated. The DSP 210 may accomplish this compensation by pre-processing the modulated signal and/or post-processing the read signal. The DSP 210 controls the drive motors 214 and the record head 218 via the power amplifier 212 to record the modulated signal on the multimedia disk 216. The DSP 210 also controls the drive motors 214 and uses the read head 220 to scan the multimedia disk 216 and produce a read signal.

The channel control buffer 222 provides buffering of the read signal, while demodulator 224 demodulates the read signal and error correction code decoder 226 decodes the demodulated signal. After decoding the demodulated signal, the error correction decoder 226 forwards the decoded signal to multimedia decoder 228.

Multimedia decoder 228 operates to decode the output of the error correction decoder 226 to produce a digital audio signal and digital video signal, as well as a bypass audio bitstream. The operation and structure of multimedia decoder 228 are discussed further below. The digital audio signal and digital video signal may be converted to analog audio and video signals before being sent to display monitor 106. The bypass audio bitstream is provided directly to an external audio component.

Figure 3:
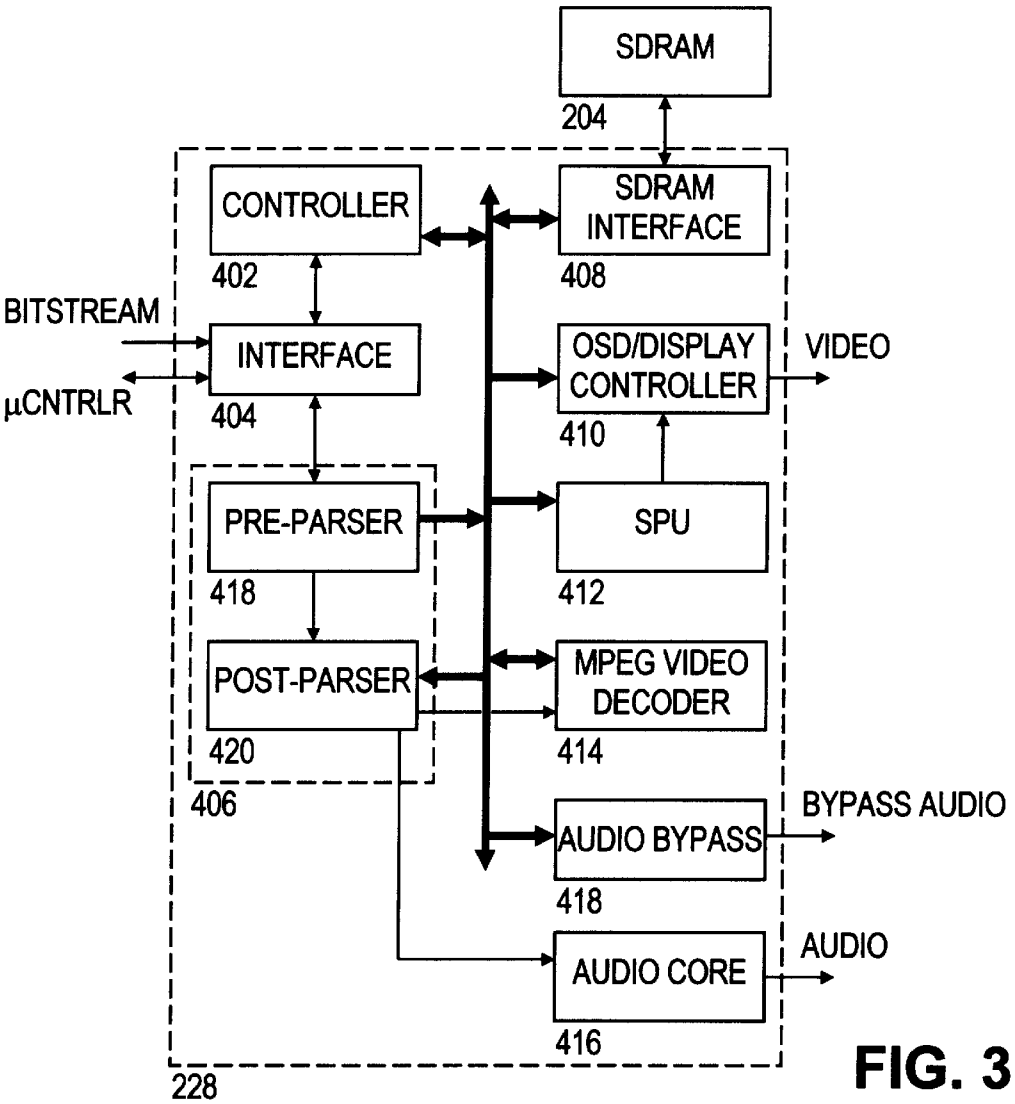
FIG. 3 shows a block diagram of a multimedia bitstream decoder.

Turning now to FIG. 3, a block diagram of one embodiment of multimedia decoder 228 is shown. Multimedia decoder 228 comprises a controller 402, a host interface 404, a variable length decoder (VLD) 406, a memory interface 408, a display controller 410, a sub-picture unit (SPU) 412, an MPEG video decoder 414, an audio decoder 416, and an audio bypass module 418. VLD 406 includes a pre-parser 418 and a post-parser 420. Controller 402 is coupled to the rest of the modules of multimedia decoder 228 to configure their behavior by setting various configuration registers and to monitor their performance. Controller 402 may also transmit status and request information to an external microcontroller 230. Host interface 404 is coupled to controller 402 and VLD 406, and is configured to receive an encoded multimedia bitstream and to communicate with an external microcontroller 230. Various operating instructions (e.g. reset, begin decode, playback mode) may be provided by external microcontroller 230 to controller 402 via host interface 404. Other operating instructions may be found in the encoded multimedia bitstream and provided to controller 402 (e.g. navigation commands).

VLD decoder 406 receives the encoded multimedia bitstream from host interface 404 and parses the encoded multimedia bitstream. Pre-parser 418 determines the substream membership of each data packet from the packet header and routes the packet contents (minus identifying fields from the packet header) to the appropriate elementary bitstream buffer in memory 204, where they wait on the availability of the associated module to begin being processed. Certain data packets (e.g. SPU substream, navigation substream) are retrieved directly from the appropriate buffer in memory 204 by the associated module. However, many of these data packets may have variable-length encoded data (e.g. compressed audio and video). These data packets are passed to the associated module via post-parser 420. Post-parser 420 parses the bitstream syntax and performs elementary operations such as extracting the bit allocation and scaling information from the headers and applying that information to convert the variable-length encoded data into fixed-length transform coefficients for subsequent modules to process.

Memory interface 408 acts as a bus arbiter and provides access to memory 204 for the other modules. Display controller 410 retrieves decoded digital video data from a buffer in memory 204 and provides it in raster order as a digital video output. Display controller 410 may incorporate an on-screen display (OSD) unit that can overlay system information on the video image, e.g. configuration menus, time, channel, volume, etc. Display controller 410 may also be coupled to overlay bitmap signals from other modules onto the video image. SPU controller 412 retrieves bitstream information from an SPU buffer in memory 204, decodes it into bitmap information, and provides the resulting bitmap signals to display controller 410 for possible display.

Video decoder 414 receives variable-length decoded transform coefficients from post-parser 420 and decodes them to generate decoded video data. The decoding process typically involves reference to anchor frames stored in frame buffers in memory 204. Video decoder 414 retrieves anchor frame data from the frame buffers and writes the decoded video data to anchor frame buffers or to intermediate buffers from which it is retrieved by display controller 410 for display.

Audio decoder 416 receives audio data from post-parser 420. Audio decoder 416 is configurable to convert transform coefficients into digital audio samples, e.g. PCM data. Audio decoder 416 may be an economical implementation that only decodes left and right audio channels and discards information regarding other audio channels. As data is retrieved from the elementary audio bitstream buffer in memory 204 for audio decoder 416, an audio decoder buffer pointer tracks the location of the next byte to be retrieved by the audio decoder 416.

Audio bypass module 418 retrieves data directly from the elementary audio bitstream buffer in memory 204, and tracks the location of the next byte to be retrieved using an audio bypass buffer pointer. Audio bypass module 418 then formats the data into subframes, and transmits the formatted data to any external interface coupled to receive the bypass audio signal. The audio bypass module 418 is configured to maintain a loose synchronization with the audio decoder 416 to avoid introducing any undesired delays between reproduced audio signals.

Figure 4:
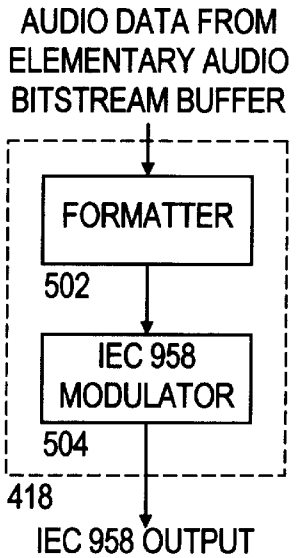
FIG. 4 shows a block diagram of an audio bypass module.

FIG. 4 shows one embodiment of audio bypass module 418. Audio bypass module 418 includes a data formatter 502 and an IEC 958 modulator 504. Formatter 502 is configured to locate the beginning of an audio packet in the elementary audio bitstream buffer, to compare the decoder pointer to the bypass pointer to determine if the audio decoder is ahead of or behind the audio bypass module, and to take corrective action if a significant disparity exists. The formatter 502 is further configured to format the audio data into subframes for the modulator 504 to transmit. Modulator 504 is configured to convert subframes from formatter 502 into a serial, bi-phase coded, analog channel signal in accordance with the IEC 958 standard (IEC 958 First edition 1989–03: Digital audio interface) which is hereby incorporated by reference. Modulator 504 may include a input buffer for subframes provided from formatter 502.

The behavior of formatter 502 is dependent on the format of the audio packets in the elementary bitstream buffer. Pre-parser 418 determines the audio packet type and sets appropriate register values for the audio decoder 416 and the audio bypass module 418. For compressed audio packets, such as MUSICAM or AC-3, a synchronization field is included at the beginning of each audio packet in the elementary bitstream buffer. The formatter 502 begins operation by locating this synchronization word. The formatter 502 then pre-appends four 16-bit words to the audio packet and appends zeros as necessary to provide the audio packet with a predetermined length. The prepended words are denoted (in order) Pa, Pb, Pc, Pd. Pa and Pb are synchronization words, Pc identifies the compression standard for the audio packet, and Pd indicates the audio packet size. The enhanced audio packet is then taken 16 bits at a time and formatted into 32-bit subframes. The subframes each consist of a 4-bit synchronization preamble, four auxiliary bits, four zeros, 16 audio packet bits, and four subframe bits. The four subframe bits are validity (V), user (U), control (C) and parity (P). The use and meaning of the subframe components is described further in the IEC 958 standard and the DVD standard.

Figure 5:
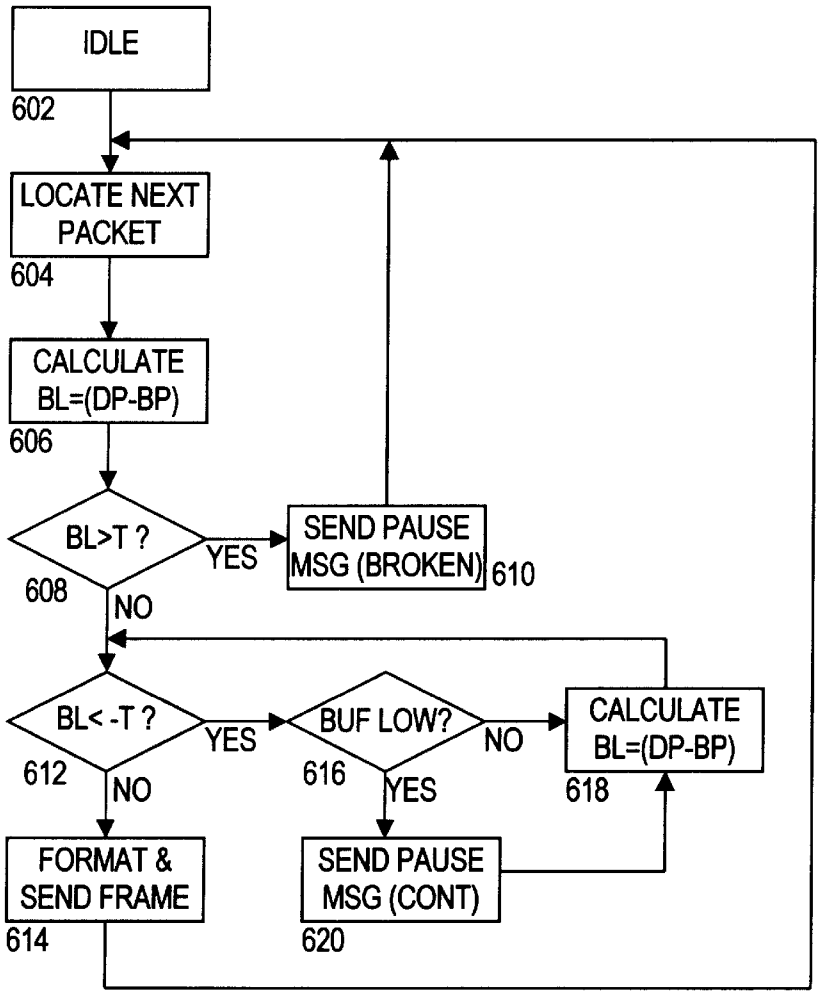
FIG. 5 shows a flowchart of the operations which may be implemented by an audio bypass formatter.

FIG. 5 shows a flowchart of the operations implemented by one embodiment of formatter 502. The flowchart consists of idle state 602, locate operation 604, calculate operation 606, compare operation 608, pause operation 610, compare operation 612, format operation 614, buffer check operation 616, calculate operation 618, and pause operation 620. Formatter 502 begins in idle state 602 and re-enters the idle state 602 whenever a reset signal is asserted. When the audio bypass module 418 is enabled, formatter 502 begins by locating (604) the beginning of an audio packet in the elementary audio bitstream buffer by retrieving the audio data and searching for a synchronization word. Once the beginning of the audio packet has been found, the bypass pointer (BP) is compared (606) to the decoder pointer (DP) to determine the bypass lag (BL), i.e. the number of bytes that the audio decoder 416 is ahead of the bypass module 418 in retrieving audio data from the audio bitstream buffer. The lag can be negative, e.g. when the bypass module 418 is ahead of the decoder 416. Whenever the magnitude of the lag exceeds a predetermined threshold T, the formatter will take corrective action. In one embodiment, the predetermined threshold T is an integer multiple of the audio packet size. Preferably, the predetermined threshold T is 1, 2, or 4 times the audio packet size.

After determining (606) the bypass lag BL, the formatter 502 tests (608) to determine if the bypass lag BL exceeds predetermined threshold T. If so, the formatter 502 creates (610) a pause subframe for modulator 504 to transmit. The pause subframe uses a synchronization preamble with a different Pc field value to indicate that the subframe is a pause subframe, but otherwise resembles the 32-bit subframes previously described. The pause subframe includes a discontinuity flag which can be set to indicate a loss of a data packet. The discontinuity flag is set in this pause subframe, and formatter 502 skips forward (604) to the beginning of the next audio packet.

If the bypass lag doe not exceed the predetermined threshold, then the formatter 502 tests (612) to determine if the bypass lag is less than the negative threshold T, i.e. the formatter 502 determines if the bypass module 418 is too far ahead of the decoder 416. If not, then formatter 502 converts (614) the audio packet into subframes for the modulator 504 to transmit. After conversion of the audio packet, the formatter 502 locates (604) the beginning of the next audio packet.

If the bypass module 418 is too far ahead of the audio decoder 416, then formatter 502 will loop while waiting for the audio decoder 416 to catch up. Formatter 502 tests (616) to determine if the modulator input buffer is low. If not, then formatter 502 recalculates (618) the bypass lag BL, and loops back to compare (612) the bypass lag BL to the threshold T. If the buffer is low, the formatter 502 creates (620) one or more cause subframes for modulator 504 to transmit, recalculates (618) the bypass lag BL, and loops back to compare (612) the bypass lag BL to the threshold T. The pause subframes here do not have the discontinuity flag sent, since no audio packets are being skipped.

It is noted that bypass module 418 advantageously maintains a loose synchronization with audio decoder 416—a synchronization which prevents a large time discrepancy from developing between the final output audio signals reproduced by the audio decoder and the external audio component, and which also expedites delivery of complete audio bitstream data to the external component to facilitate its operation. The described method advantageously provides for a low cost, straightforward implementation in hardware or software, and allows for sophisticated equipment to be coupled with economical multimedia decoders without impairing the performance of the sophisticated equipment.

Numerous variations and modifications will become apparent to those skilled in the art once the above disclosure is fully appreciated. It is intended that the following claims be interpreted to embrace all such variations and modifications.

What is claimed is:

1. A multimedia decoder which comprises:

a memory configured to buffer an audio bitstream, wherein the audio bitstream includes a sequence of audio data packets;

an audio decoder coupled to the memory to receive the audio bitstream, wherein a decoder pointer is used to determine which byte of the audio bitstream is to be provided to the audio decoder next;

a bypass module coupled to the memory to retrieve the audio bitstream, wherein a bypass pointer is used to determine which byte of the audio bitstream is to be provided to the bypass module next, wherein the bypass module is configured to determine a difference between the bypass pointer and the decoder pointer, wherein the bypass module is configured to compare the difference to a predetermined threshold, and wherein the bypass module is configured to retrieve and transmit audio data from an audio data packet if the difference has a magnitude that does not exceed the predetermined threshold.

2. The multimedia decoder of claim 1, wherein the bypass module is further configured to wait if the magnitude of the difference exceeds the predetermined threshold and indicates that the audio decoder is lagging behind the bypass module.

3. The multimedia decoder of claim 2, wherein the bypass module is configured to monitor a transmission buffer and to transmit a pause message with a discontinuity flag de-asserted if the transmission buffer becomes nearly empty.

4. The multimedia decoder of claim 2, wherein the bypass module is further configured to skip to a next audio packet if the magnitude of the difference exceeds the predetermined threshold and indicates that the bypass module is lagging behind the audio decoder.

5. The multimedia decoder of claim 4, wherein the bypass module is configured to transmit a pause message with a discontinuity flag asserted if the bypass module skips to the next audio packet.

6. The multimedia decoder of claim 4, wherein the predetermined threshold is an integer multiple of an audio packet size.

7. The multimedia decoder of claim 4, further comprising:

a pre-parser configured to receive a multimedia bitstream, configured to identify data packets from the multimedia bitstream as audio data packets and video data packets, and configured to route the audio data packets to an audio bitstream buffer in the memory and the video data packets to a video bitstream buffer in the memory; and a video decoder coupled to the memory to receive and decode a video bitstream into a sequence of video frames.

8. The multimedia decoder of claim 4, wherein the audio decoder is configured to convert at least a portion of the audio bitstream into a set of digital audio signals.

9. The multimedia decoder of claim 8, wherein the bypass module is coupled to transmit the audio bitstream to an external decoder configured to convert a greater portion of the audio bitstream into a second set of digital audio signals.

10. The multimedia decoder of claim 4, wherein the bypass module includes:

a formatter configured to format the audio packets for transmission; and a modulator configured to convert the formatted audio packets into a channel signal, and configured to transmit the channel signal in accordance with the IEC958 standard.

11. The multimedia decoder of claim 10, wherein the formatter formats the audio data packet by adding a synchronization field, a compression word, and a size word to the beginning of the audio data packet, by dividing the augmented audio data packet into 16-bit words, and by formatting each of the 16-bit words as 32-bit subframes.

12. A method for providing upgradeability to a multimedia decoder, wherein the method comprises:

retrieving audio data from an audio bitstream buffer for an audio decoder;

incrementing a decoder pointer for every audio data unit retrieved for the audio decoder;

retrieving audio data from the audio bitstream buffer for a bypass module;

incrementing a bypass pointer for every audio data unit retrieved for the bypass module;

calculating a difference between the bypass pointer and the decoder pointer;

comparing a magnitude of the difference to a predetermined threshold;

formatting an audio data packet for transmission if the magnitude does not exceed the predetermined threshold.

13. The method of claim 12, further comprising:

skipping to a next audio data packet if the magnitude does exceed the predetermined threshold and the difference indicates that the bypass module is lagging behind the audio decoder.

14. The method of claim 13, wherein the skipping includes:

generating a pause message with a discontinuity flag asserted.

15. The method of claim 13, further comprising:

waiting if the magnitude does exceed the threshold and the difference indicates that the decoder module is lagging behind the bypass module.

16. The method of claim 15, wherein the waiting includes:

monitoring a transmission buffer; and generating a pause message with a discontinuity flag de-asserted if the transmission buffer becomes nearly empty.

17. The method of claim 15, wherein the formatting includes:

if the audio data packet includes compressed audio data:

adding a compression field to the audio data packet to identify a compression type;

adding a size field to the audio data packet to identify a size of the audio data packet;

appending zeros to the audio data packet to enforce a minimum packet length;

formatting each 16-bits of the audio data packet into 32-bit subframes;

modulating the 32-bit subframes onto a multimedia decoder output signal.

18. The method of claim 15, wherein the formatting includes:

if the audio data packet includes linear PCM audio data:

reconstructing a sequence of digital audio samples from the linear PCM audio data;

formatting each digital audio sample into a 32-bit subframe; and modulating the 32-bit subframes onto a multimedia decoder output signal.

19. The method of claim 15, wherein the audio data unit is one byte of audio data.

* * * * *